US007386268B2

(12) United States Patent
Terashima

(10) Patent No.: US 7,386,268 B2
(45) Date of Patent: Jun. 10, 2008

(54) IMAGE FORMING APPARATUS

(75) Inventor: Hitoshi Terashima, Kahoku (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 11/385,894

(22) Filed: Mar. 22, 2006

(65) Prior Publication Data

US 2006/0216091 A1 Sep. 28, 2006

(30) Foreign Application Priority Data

Mar. 25, 2005 (JP) ..... 2005-087763

(51) Int. Cl.
*G03G 15/00* (2006.01)

(52) U.S. Cl. ..... 399/401; 399/400

(58) Field of Classification Search ..... 399/66, 399/364, 306, 392, 22, 371, 363, 381, 397–401; 503/227; 430/331, 204
See application file for complete search history.

(56) References Cited

U.S. PATENT DOCUMENTS

| | | | | |
|---|---|---|---|---|
| 4,857,963 | A * | 8/1989 | Sutou | 399/381 |
| 5,797,077 | A * | 8/1998 | Samizo et al. | 399/309 |
| 5,978,642 | A * | 11/1999 | Arcaro et al. | 399/381 |
| 5,995,802 | A * | 11/1999 | Mori et al. | 399/394 |
| 6,173,148 | B1 * | 1/2001 | Matsuda et al. | 399/310 |
| 6,347,214 | B1 * | 2/2002 | Kaneko | 399/397 |
| 6,536,863 | B1 * | 3/2003 | Beauchamp et al. | 347/17 |
| 6,556,804 | B1 * | 4/2003 | Lobel et al. | 399/306 |
| 6,643,489 | B2 * | 11/2003 | Omata et al. | 399/309 |
| 6,801,742 | B1 * | 10/2004 | Mochimaru et al. | 399/309 |
| 7,039,349 | B2 * | 5/2006 | Sohmiya et al. | 399/309 |
| 2002/0015602 | A1 * | 2/2002 | Mochimaru et al. | 399/309 |
| 2002/0051659 | A1 * | 5/2002 | Baba et al. | 399/307 |
| 2002/0076242 | A1 * | 6/2002 | Arcaro et al. | 399/301 |
| 2004/0037601 | A1 * | 2/2004 | Uchida et al. | 399/396 |
| 2004/0175215 | A1 * | 9/2004 | Tsuchida | 399/401 |
| 2005/0053388 | A1 * | 3/2005 | Yokoyama et al. | 399/66 |

FOREIGN PATENT DOCUMENTS

| | | |
|---|---|---|
| JP | 5-66631 | 3/1993 |
| JP | 6-27759 | 2/1994 |
| JP | 7-128921 | 5/1995 |

* cited by examiner

*Primary Examiner*—Anthony H. Nguyen

(57) ABSTRACT

A toner image is transferred from a photo-receptor onto an intermediate transfer unit. A back up roller faces the intermediate transfer unit and is operable to transfer the toner image onto a sheet, thereby image formation is performed. A switch back unit is operable to turn the sheet inside out to perform the image formation onto a reverse face of the sheet after the image formation is performed onto an obverse face of the sheet. A fixing unit is operable to fix the toner image on at lease one of the obverse and reverse faces of the sheet. A switching unit is operable to transport the sheet toward the fixing unit or the switch back unit after the image formation is performed onto the obverse face of the sheet. In a case where the image formation is performed onto the obverse and reverse faces of the sheet, after the image formation is performed onto the obverse face of the sheet, the sheet is transported to the switch back unit, and after the image formation is performed onto the obverse and reverse faces of the sheet, the fixing unit fixes the toner image on the obverse and reverse faces of the sheet.

11 Claims, 3 Drawing Sheets

IMAGE FORMING APPARATUS

BACKGROUND OF THE INVENTION

The present invention relates to an image forming apparatus, particularly to a liquid toner development electrophotographic apparatus having a mechanism capable of performing printing on both sides of a sheet of paper by using a non-volatile, highly viscous and highly concentrated liquid toner as the developer.

As an art enabling double-sided printing in an electrophotographic recording apparatus, one based on switch back process is known (for example, refer to JP-A-5-66631 and JP-A-7-128921). FIG. 3 shows a related image forming apparatus having a switch back unit. In the drawing, a sheet of paper in a hopper is taken out by a pick up unit. The picked up sheet is transported to arrive at an image transfer section where an image is recorded on one face of the sheet. The sheet is temporarily sent to a buffer section after passing a fixing unit. After the trailing edge of the sheet passes the fixing unit and is completely accommodated in the buffer section, the sheet is switched back and transported in the opposite direction. Namely, the trailing edge for the one face recording is now transported as the leading edge in the transport direction. Thereafter, the sheet advances to a transport path beneath the fixing unit to pass the upper surface of the hopper. Then, the sheet is reversed in a sheet feed section whereby the first recording face is directed downward with the unrecorded face directed upward. Next, the sheet is sent again to the image transfer section, where image recording on the opposite face is performed and thereafter passes the fixing unit. The sheet, on both sides of which images have been recorded in this manner passes, the buffer section and is exhausted to a stacker.

Still another related art is known, in which a sheet having an image recorded on one face thereof is once stacked in a tray different from a hopper, and is transported to an image transfer section from the tray in sequence (refer to JP-A-6-27759).

In this manner, in a related electrophotographic recording apparatus, the sheet transport path for double-sided printing is such that, after a sheet has passed a fixing unit, the sheet transport path is switched to transport the sheet again to an image transfer section. But, when the sheet is transported again to the image transfer section after passing the fixing unit, the length of the sheet transport path is elongated, which increases the number of sheet wasted inside the apparatus (residual sheets in the apparatus) in case of irregular event occurrence (such as sheet jamming).

Further, with the expansion the length of the sheet transport path, the accuracy of printing position deteriorates for reverse face printing. Moreover, in case of double-sided printing, it is necessary to pass the sheet twice through the fixing unit, which doubles the consumption of the electric power for the heater.

SUMMARY

It is therefore an object of the invention to provide an image forming apparatus in which a sheet is passed only once through a fixing unit for double-sided printing, so that the electric power consumption for the heater is reduced, and in which the length of the sheet transport path is curtailed, so that the number of sheets wasted inside the apparatus is reduced in case of irregular event occurrence and the positional accuracy of the sheet is improved.

In order to achieve the object, according to the invention, there is provided an image forming apparatus comprising:

an intermediate transfer unit, onto which a toner image is transferred from a photo-receptor;

a back up roller, facing the intermediate transfer unit, and operable to transfer the toner image onto a sheet, thereby image formation is performed;

a switch back unit, operable to turn the sheet inside out to perform the image formation onto a reverse face of the sheet after the image formation is performed onto an obverse face of the sheet; and a fixing unit, operable to fix the toner image on at lease one of the obverse and reverse faces of the sheet, a switching unit, operable to transport the sheet toward the fixing unit or the switch back unit after the image formation is performed onto the obverse face of the sheet, wherein in a case where the image formation is performed onto the obverse and reverse faces of the sheet, after the image formation is performed onto the obverse face of the sheet, the sheet is transported to the switch back unit, and after the image formation is performed onto the obverse and reverse faces of the sheet, the fixing unit fixes the toner image on the obverse and reverse faces of the sheet.

The image forming apparatus may further comprise a pre-heat roller, having a heater therein for heating the sheet prior to the image formation is performed.

The pre-heat roller may be provided with a clamping member clamping the sheet so as to transport the sheet to the back up roller.

The switching unit may include a clamping member, clamping the sheet, and provided on the back up roller; and a controller, controlling the clamping member to select one of first and second release positions where the clamping member releases the sheet. The sheet may be transported toward one of the fixing unit and the switch back unit.

The image forming apparatus may further include a separation member, separating the sheet at the first release position from the back up roller toward the fixing unit.

The image forming apparatus may further include a separation member, separating the sheet at the second release position from the back up roller toward the switch back unit.

Transport speed of the sheet in the switch back unit may be varied to match the timing for the sheet to reach the clamping member.

Length of transport path of the sheet in the switch back unit may be set at substantially a multiple of standard size of the sheet.

The intermediate transfer unit may be set at a temperature capable of softening a resinous component dispersed in a carrier liquid of liquid toner, In order to achieve the object, according to the invention, there is also provided an image forming comprising:

an image forming unit, operable to form an image onto at least one face of a medium transported in a first transport path in a transport direction;

a fixing unit, disposed at a downstream side of the image forming unit in the transport direction, and operable to fix the image on the medium;

a switch back unit, disposed in a second transport path, the second transport path:

connected to the first transport path at an upstream side of the image forming unit in the transport direction;

connected to the first transport path at a switching area arranged between the image forming unit and the fixing unit; and adapted to transport the medium while turning inside out; and a switching unit, arranged at the switching area, and operable to selectively guide the sheet toward one of the fixing unit and the switch back unit.

According to an aspect of the invention, the configuration of the apparatus can be simplified since the paper is transported to the switch back unit by being reversed of the transport direction by means of the back up roller after obverse face printing without fixation, thus curtailing the sheet transport path length. Further, due to such a short sheet transport path length, the number of (wasted) paper remaining in the apparatus upon erroneous event occurrence. Still further, by virtue of the curtailed sheet transport path length, the registration accuracy for the both sides improves. The electric power consumption at the fixing unit is reduced by half since the sheet passes the fixing unit only once for double-sided printing.

DETAIL DESCRIPTION OF PREFERRED EMBODIMENTS

In the following, the invention is described with reference to an example of a liquid toner development electrophotographic apparatus. The non-volatile liquid toner used in the present apparatus includes non-volatile silicone oil as carrier liquid, and toner particles, dispersed in this silicone oil, made of a resin and a pigment.

Figure 1:
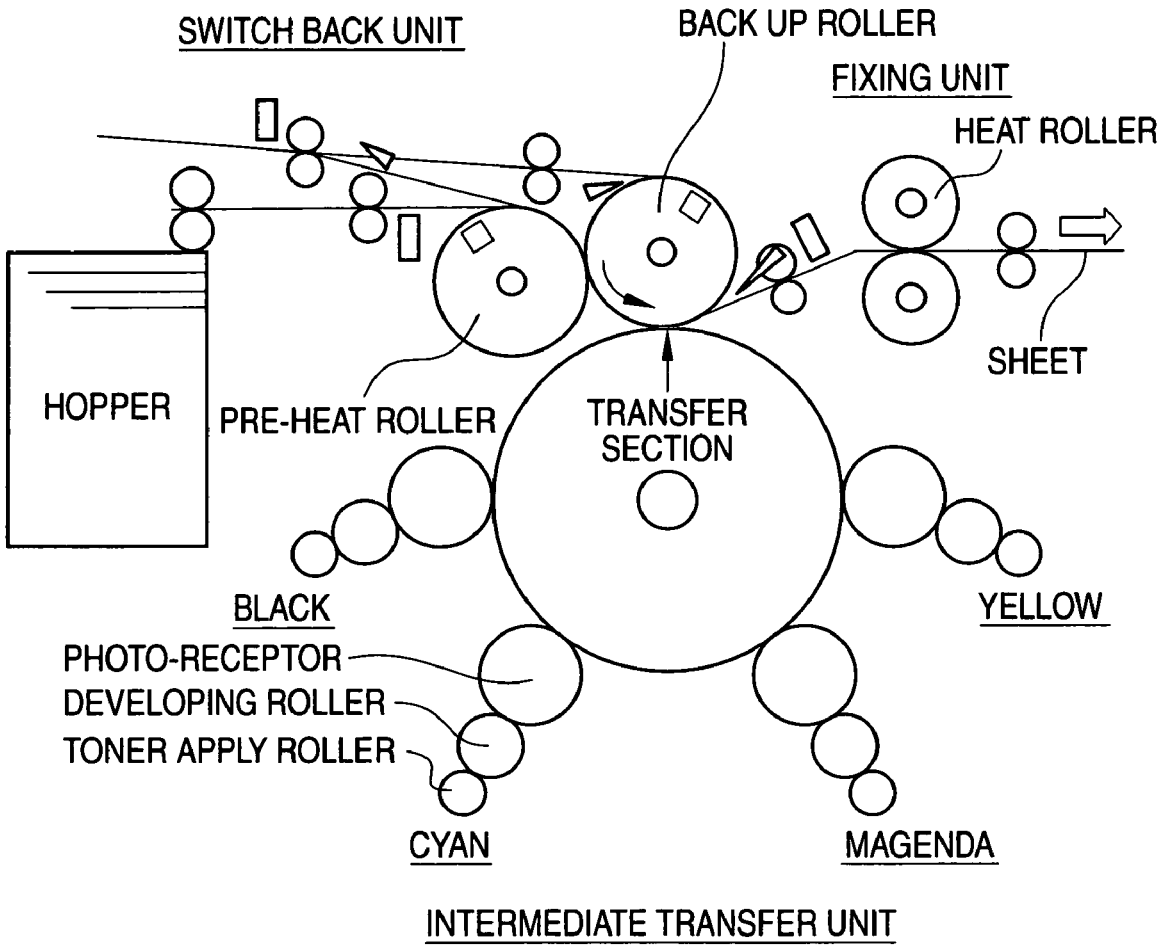
FIG. 1 is a diagram showing the overall configuration of a liquid toner development electrophotographic apparatus according to the invention.

As shown in FIG. 1, a full-color electrophotographic apparatus is configured of photo-receptors, each of which corresponds to one of yellow, magenta, cyan and black colors and is shown in drum shape as an example, arranged around and being in contact with an intermediate transfer unit exemplified by one having a drum shape. While making one rotation, the intermediate transfer unit is brought in contact with the photo-receptor corresponding to the individual colors, whereby monochromatic color images are superimposed sequentially on the intermediate transfer unit to form a full-color image.

Each photo-receptor is provided with a charging unit (not shown in the drawing) to charge the photo-receptor, an exposure unit (not shown in the drawing) to form an electrostatic latent image on the photo-receptor by exposing the charged photo-receptor based on image data, and a blade (not shown in the drawing) to scrape off the residual toner. In addition each photo-receptor is in contact with a development roller.

The development roller, which is biased to a pre-determined potential, supplies the charged toner to the photo-receptor according to the electric field between the development roller and the photo-receptor. With such operation, the electrostatic latent image on the photo-receptor is developed by adhering the toner onto the exposed portion of the charged photo-receptor so as to form an image. The toner apply roller is configured of one or plural rollers for each color to apply the liquid toner onto the development roller.

On the intermediate transfer unit, the toner adhered on the photo-receptor is transferred according to the electric field between the intermediate transfer unit and the photo-receptor. The intermediate transfer unit is maintained by heating with a heater accommodated in the interior thereof at a softenable temperature where the resinous component dispersed in the carrier liquid of the liquid toner is softenable. Here the term 'softenable temperature' indicates 'a temperature at which the resinous component begins to soften (glass transition point Tg)' or higher and 'a temperature at which the resinous component begins to melt (melting point=melting temperature Tm)' or less. In other words, the following relationship holds; $Tg \leqq$ softenable temperature $\leqq Tm$, and this range differs depending on the kind of toner (resin). At the 'softenable temperature', the liquid toner is plastically deformable, but forms a rubber layer with no fluidity. Below this temperature range, the liquid toner forms a solid phase that cannot plastically deform, while, above this temperature range, it forms a flowable and deformable liquid phase. A carrier-removing roller (not shown in the drawing), which is arranged on the intermediate transfer unit, is configured so as to remove the carrier liquid from the toner image on the intermediate transfer unit.

First of all, on the intermediate transfer unit, the yellow toner adhered on the first photo-receptor is transferred. Thereafter the intermediate transfer unit reaches the transfer section for magenta toner as a second color, and at that section, the magenta toner adhered on the second photo-receptor is transferred, then in succession, the cyan toner adhered on the third photo-receptor is transferred, and finally the black toner adhered on the fourth photo-receptor is transferred. In such a manner, the four color toner images developed on the first to fourth photo-receptors are superimposed sequentially on the intermediate transfer unit so as to form a full-color image. The superimposed four-color, full-color image on the intermediate transfer unit from which the carrier liquid has been removed is pressed against a sheet for transfer by means of the intermediate transfer unit under consistent heating and a back up roller with an installed heater.

In addition, at least one heater-installed roller (pre-heat roller), which preliminarily heats a sheet (medium) is arranged at an upstream side of the intermediate transfer unit where is the position in front of a position at which the sheet is brought into contact with the intermediate transfer unit. By preliminarily heating the sheet prior to image transfer, it becomes easy at the step of image transfer to control the visco-elastic property of the resinous component dispersed in the carrier liquid of the toner. The pre-heat roller arranged at a position that can heat not only the sheet transported from the hopper but also the one transported after reversed by the switch back unit. With such configuration, the sheet paths prior to the transfer onto the obverse and reverse faces can be made common, eliminating the necessity of preparing two preliminarily heating rollers (pre-heat rollers) and thus achieving simple configuration.

In order to maintain the temperature of preliminarily heated sheet in the transfer section at the nip formed between the intermediate transfer unit and the back up roller, the back up roller is also heated so as to keep a temperature at which the resinous component dispersed in the carrier liquid of the liquid toner is softenable.

Fixing unit fuses and fixes the toner image on the sheet by applying pressure on the sheet by means of two heat rollers. To ensure the fixing strength, the full-color image transferred on the sheet is subjected to heating at a further elevated temperature and a higher pressure by means of the heat rollers after image transfer.

Figure 2:
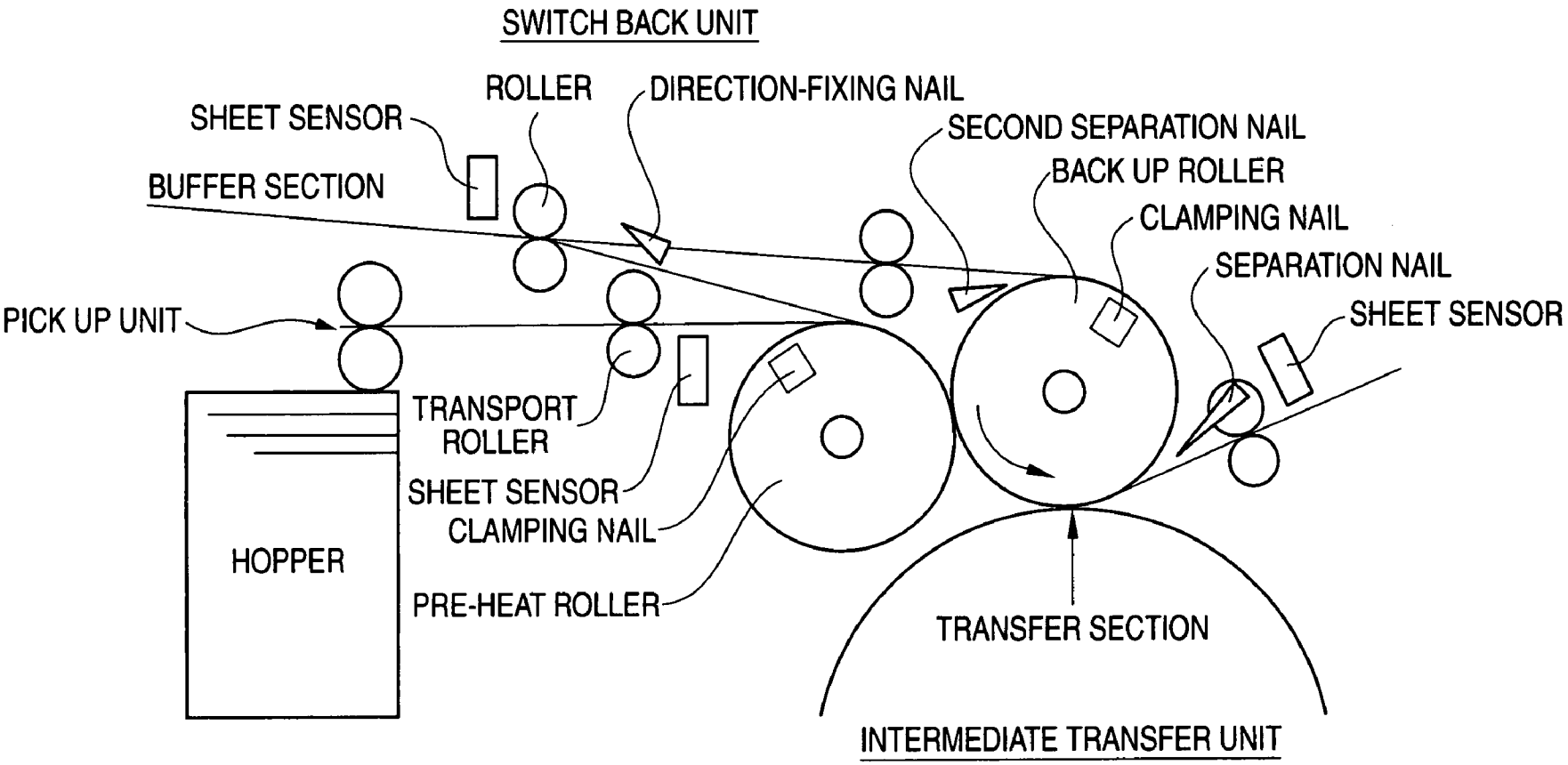
FIG. 2 is a diagram showing the detail of the sheet transport path shown in FIG. 1.
Figure 3:
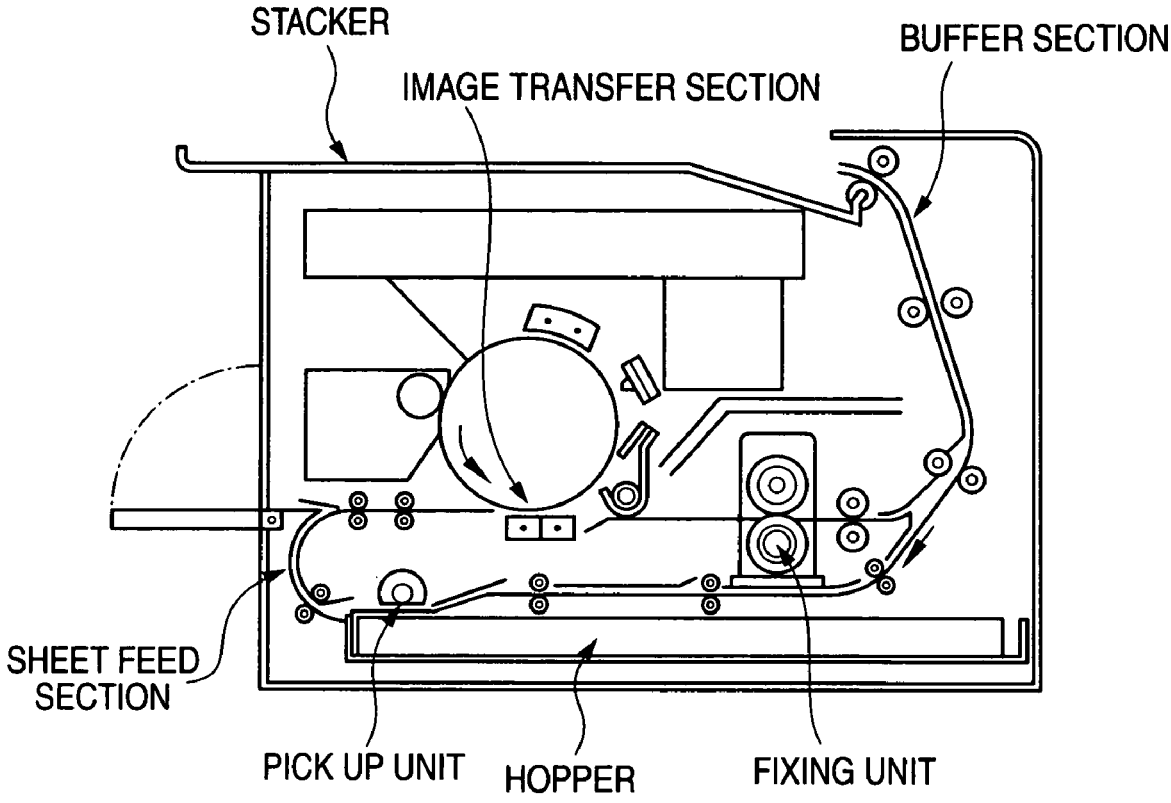
FIG. 3 is a diagram showing the switch back unit according to a related art.

The image forming apparatus shown in FIG. 1 has a configuration capable of printing also on the reverse face of the sheet. With respect to the configuration for reverse face printing, description is given with reference to FIG. 2. Sheets stacked on the hopper are fed, one by one, in the interior of the apparatus by means of a pick up unit arranged at the end of the hopper. The picked paper is transported to the pre-heat roller by transport rollers. A sheet sensor detects the position of the sheet. The sheet transported to the pre-heat roller is held at the leading edge by a clamping nail (clamping means) arranged on the pre-heat roller and moves along with the rotation of the pre-heat roller.

Since the angle with which the sheet advances towards the pre-heat roller varies for the aforementioned obverse face printing and for the reverse face printing to be described below, the system is disadvantageous from the viewpoint of consistency in sheet transport. But, by clamping the sheet with certainty by using the clamping means, sheet jamming can be suppressed at the sheet entrance section of the pre-heat roller.

By releasing this clamping nail at a pre-determined position, the sheet is released from the pre-heat roller. By holding the leading edge of the sheet with a clamping nail arranged at the back up roller immediately after the releasing, the sheet is delivered from the pre-heat roller to the back up roller. On the sheet held by the back up roller, a full-color image on the intermediate transfer unit is transferred at the contact position of the intermediate transfer unit, as stated previously.

After image transfer for a single face printing or after image transfer onto the reverse face for double-sided printing, the sheet is transported to the fixing unit. A sheet sensor detects the sheet peeled off from the back up roller by means of a separation nail. In this case, the back up roller releases the sheet by releasing the clamping nail at a position in front of the separation nail (separation means), and then the separation nail surely separates the sheet from the back up roller to transport the sheet to the fixing unit. The clamping means arranged at the back up roller is controlled such as to select the release position of releasing the sheet clamp by a controller which is not shown in the drawings. With this configuration, the sheet clamp is released at different positions for the case of transporting (guiding) the sheet toward the fixing unit and for the case of transporting (guiding) the sheet toward the switch back unit for double-sided printing as described below.

Since the sheet that has been transported in a state in which the sheet is wound around the back up roller is adhered to the back up roller by electrostatic force or the like (electrostatic attractive force), there sometimes occur cases where the peeling off of the sheet is difficult merely by the release of the clamping nail. Even in such cases, the sheet can be consistently separated from the back up roller by driving the separation nail so as to be brought into contact with the surface of the back up roller.

After image transfer only onto the obverse face in double-sided printing, the sheet is reversed, without transported to the fixing unit, and transported to the switch back unit. As has been stated previously, since the intermediate transfer unit is set at a temperature where the resinous component dispersed in the carrier liquid of the liquid toner is softenable, the toner image is fixed to a certain degree only by the transfer onto the sheet at the transfer section. By virtue of such mechanism, it is possible to transport the sheet to the switch back unit for a second image transfer without performing perfect fixing at the fixing unit.

In the case where the sheet carrying an image on the obverse face is transported to the switch back unit, the sheet is transported in the condition that the sheet is held by the clamping nail arranged on the back up roller, and is released just in front of a second separation nail shown in the drawing by releasing the clamping nail. Then, this sheet, upon separation by means of the second separation nail, is transported to the switch back unit. In the switch back unit, the sheet is sent temporarily to the buffer section by means of at least one pair of rollers. After the sheet sensor detects that the sheet has been completely accommodated in the buffer section, the sheet is switched back for transportation in the opposite direction. In other words, the trailing edge of the sheet at single face printing is now the leading edge in the transport direction.

This sheet is directed towards the pre-heat roller by means of a direction-fixing nail, held by the clamping nail on the pre-heat roller, transported after delivered from the pre-heat roller to the back up roller in the same manner as in the case of the aforementioned obverse face printing. And, at the portion in contact with the intermediate transfer unit, the image is transferred onto the reverse face of the sheet. Via these operations, image transfers onto both sides of the sheet complete.

The sheet, which is still held by the clamping nail of the back up roller at the step of image transfer, is released from the clamping nail at a position in front of the separation nail, which, then, surely separates the sheet from the back up roller to transport to the fixing unit (refer to FIG. 1.). And the sheet, on both sides of which image transfer has been performed, is subjected to fixing performed only once.

It is necessary that the photo-receptor, the intermediate transfer unit, and the sheet transport mechanism and the like (a synchronized driving system) are driven in synchronism so that the image formed on the intermediate transfer unit is transferred to the pre-determined position of the sheet. But, until the sheet in the switch back unit comes to be held by the clamping nail of the pre-heat roller, the switch back unit can be driven independently of the synchronized driving system. Thus, by configuring the sheet transport speed in the switch back unit to be variable so that the sheet can reach the position of the clamping nail on the pre-heat roller in appropriate timing, it becomes possible to prevent wasteful rotation (rotation of the pre-heat roller without any sheet therearound), thus consistently achieving the maximum throughput.

Moreover, the length of the sheet transport path in the switch back unit is set substantially at a multiple of the standard size of the sheet. With this measure, even in the case where the sheet in the switch back unit is transported at the ordinary process speed, an appropriate timing for the leading edge of sheet reaches the position corresponding to the clamping nail of the pre-heat roller can be approximated whereby the degree of changing the sheet transport speed in the switch back unit can be made as small as possible. To change the sheet transport speed during transportation is not preferred from the viewpoint of positional accuracy of sheet. But, by setting the length of the sheet transport path to be substantially equal to a multiple of a standard sheet size which is used in common, the degree of variation in the sheet transport speed as well as the duration of the varied speed can be minimized, thus achieving consistent sheet transport.

Although the present invention has been described with reference to the liquid toner development electrophotographic apparatus, the technical scope of the invention is not limited to the scope described in the above liquid toner development electrophotographic apparatus. For example, the technical scope of the invention is applied to an image forming apparatus in which an image developed by using powdery toner instead of liquid toner.

What is claimed is:

1. An image forming apparatus comprising:

an intermediate transfer unit, onto which toner images are formed by at least one photo-receptor;

a back up roller, in contact with the intermediate transfer unit in a transfer section, allowing a sheet to pass in-between the back-up roller and the intermediate transfer unit, to transfer toner images from the intermediate transfer unit onto the sheet;

a switch back unit, to receive a sheet having a first toner image transferred on one side, and to return the sheet to pass a second time between the back up roller and the intermediate transfer unit so that a second toner image is transferred onto a side of the sheet opposite to a side on which the first toner image was transferred;

a fixing unit, operable to fix the toner image on at least one of side of the sheet; and a switching unit, disposed between the transfer section and the fixing unit, operable to direct the sheet received from the transport section toward one of the fixing unit and the switch back unit, wherein if toner images are transferred on both sides of the sheet, the fixing unit fixes the toner images on the sheet during a single pass of the sheet through the fixing unit.

2. The image forming apparatus set forth in claim 1, further comprising a pre-heat roller, heating the sheet prior to a first pass between the intermediate transfer unit and the back-up roller.

3. The image forming apparatus set forth in claim 2, wherein the pre-heat roller is provided with a clamping member clamping the sheet so as to transport the sheet to the back up roller.

4. The image forming apparatus set forth in claim 1, wherein the switching unit comprises:

a clamping member, clamping the sheet, and provided on the back up roller controlled to selectively release the sheet at one of first and second release positions depending on whether the sheet is transported toward the fixing unit or the switch back unit.

5. The image forming apparatus set forth in claim 4, further comprising a separation member, separating the sheet at the first release position from the back up roller toward the fixing unit.

6. The image forming apparatus set forth in claim 4, further comprising a separation member, separating the sheet at the second release position from the back up roller toward the switch back unit.

7. The image forming apparatus set forth in claim 3, wherein a transport speed of the sheet in the switch back unit is varied to match a timing for the sheet to reach the clamping member.

8. The image forming apparatus set forth in claim 7, wherein a length of a transport path of the sheet in the switch back unit is set to be substantially a multiple of a standard size of the sheet.

9. The image forming apparatus set forth in claim 1, wherein the intermediate transfer unit is heated at a temperature at which a resinous component dispersed in a carrier liquid of liquid toner is softened.

10. An image forming apparatus, comprising:

an image forming unit, operable to form an image onto at least one face of a medium transported in a first transport path in a transport direction;

a fixing unit, disposed at a downstream side of the image forming unit in the transport direction, and operable to fix images on both faces of the medium at the same time;

a switch back unit, disposed in a second transport path, connected to the first transport path at an upstream side of the image forming unit in the transport direction and at a switching area arranged between the image forming unit and the fixing unit, adapted to transport the medium which has the image on one face to pass a second time through the image forming unit while turning the medium such as at the second pass the image to be formed on another face opposite to the one face; and a switching unit, arranged at the switching area, and operable to selectively guide the sheet toward one of the fixing unit and the switch back unit.

11. An image forming apparatus, comprising:

an image forming unit to transfer toner images on a face of a medium;

a double side switching unit, to selectively transport the medium toward a fixing unit or to direct the medium to return to the image forming unit while exposing an other face opposite to the face where a first image has been formed, to the image transfer unit allowing the image forming unit to transfer a second image on the other face of the medium, and the fixing unit to fix the first image and the second image on the medium during a single pass of the medium there-through.

* * * * *

UNITED STATES PATENT AND TRADEMARK OFFICE

CERTIFICATE OF CORRECTION

PATENT NO. : 7,386,268 B2
APPLICATION NO. : 11/385894
DATED : June 10, 2008
INVENTOR(S) : Hitoshi Terashima It is certified that error appears in the above-identified patent and that said Letters Patent is hereby corrected as shown below:

Column 7, Line 25, before “side” delete “of”.

Signed and Sealed this

Eleventh Day of November, 2008

JON W. DUDAS
*Director of the United States Patent and Trademark Office*